US005913405A

United States Patent [19]

Bordier

[11] Patent Number: 5,913,405

[45] **Date of Patent: *Jun. 22, 1999**

[54] LADYBUG (CHILD PROTECTOR)

[76] Inventor: Francisco Bordier, P.O. Box 810211, El Paso, Tex. 79927

[ * ] Notice: This patent is subject to a terminal disclaimer.

[21] Appl. No.: 07/362,477

[22] Filed: Aug. 7, 1989

[51] Int. Cl.[6] ..... A41D 13/00

[52] U.S. Cl. ..... 2/2; 2/44; 2/267; 2/92

[58] Field of Search ..... 2/2, 44, 267, 92

[56] References Cited

U.S. PATENT DOCUMENTS

| | | | |
|---|---|---|---|
| 1,532,037 | 3/1925 | Cahill | 2/2 |
| 2,266,886 | 12/1941 | McCoy | 2/2 |
| 2,446,006 | 7/1948 | Hendricks | 2/2 |
| 2,516,598 | 7/1950 | Selkirk | 2/2 |
| 2,621,327 | 12/1952 | Amoroso | 2/2 |
| 2,805,418 | 8/1957 | Sowle | 2/2 |
| 3,844,554 | 10/1974 | LaMontagne | 2/2 |
| 3,921,944 | 11/1975 | Morrison | 2/2 |
| 4,151,613 | 5/1979 | Rhee | 2/2 |
| 4,680,813 | 7/1987 | Glaeser | 2/2 |

*Primary Examiner*—Werner H. Schroeder
*Assistant Examiner*—Gloria Hale

[57] ABSTRACT

A child body protector formed of polyurethane foam in an oval shape in the design of a ladybug on its outer surface which has straps to strap onto the back of a child in order to provide cushioning from a fall which may occur while a child is learning to walk. The outer image on the protector provides amusement to the child.

1 Claim, 1 Drawing Sheet

LADYBUG (CHILD PROTECTOR)

FIELD OF INVENTION

This invention relates to a device for protecting a child who is learning to walk from the effects of a fall.

BACKGROUND OF THE INVENTION

It is known to all that children, while learning to walk, can experience many falls that can seriously injure parts of their bodies including their head and back sides.

In the prior art, a body protector for a child is not known.

OBJECTS OF THE INVENTION

It is an object of the invention to provide a child body protector to protect a child's head and backside from injury during falls while learning to walk.

Another object of this invention is to provide a child body protector that will cover and protect a child's head, lower back and buttocks area.

Another object of the invention is to provide a child body protector that is lightweight and comfortable for the child to wear and be of a pleasing and entertaining design so the child will enjoy wearing the protector.

SUMMARY OF THE INVENTION

The child body protector is substantially oval in shape and in its preferred embodiment, from a backside view, resembles the shape of a ladybug insect.

The back of the protector is to contain a design resembling a ladybugs spotted back.

The oval shaped back is to be constructed of a size large enough to cover a child's tailbone, buttocks, head and back. The body protector is also formed to the shape of the child's upper back and trunk making it comfortable to wear.

The ladybug body protector is constructed of an oval piece of polyurethane foam, preferably 1 inch in thickness and having an inner and outer surface. The outer surface of the foam is to be covered with plastic or other non-allergic materials such as fabric having the printed design such as red and black spots depicting the back of a ladybug.

Fastening straps to fasten the protector to the child will be permanently attached to the protector at the sides and upper end of the protector. the straps, preferably at ½ inch wide, are comprised of fabric with hook and loop fastening materials adhered to the ends to allow the straps to fasten to one another when wrapped around the child and uniting in a location on the child's frontside.

The child will be able to move about freely and have the use of both hands while wearing the device.

At the uppermost edge of the protector, a loop is attached so that an adult may hold the loop thereby holding and assisting the child as they walk.

DETAILED DESCRIPTION OF THE PREFERRED EMBODIMENT

Figure 1:
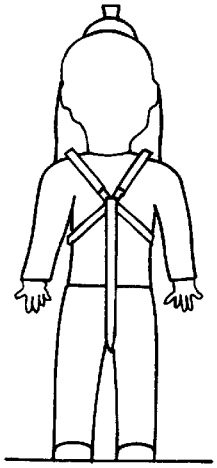
FIG. 1 is a perspective front side view of a child wearing the device.
Figure 2:
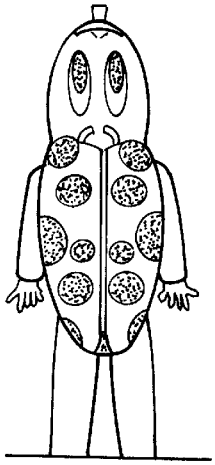
FIG. 2 is a perspective back side view of a child wearing the device.
Figure 3:
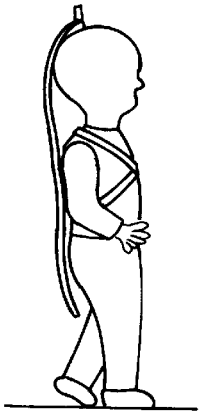
FIG. 3 is a perspective right side view of a child wearing the device.
Figure 4:
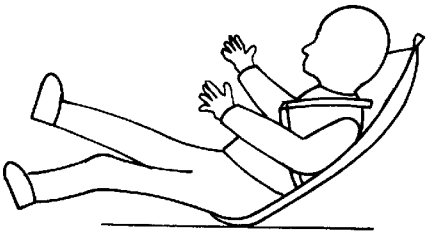
FIG. 4 is a perspective left side view of a child wearing the device in a falling position.
Figure 5:
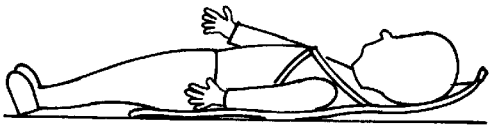
FIG. 5 is a perspective left side view of a child lying on the ground after a fall and wearing the device.

The drawings illustrate the child protector having the appearance of a ladybug on its outer surface and straps attached to its inner edges which are to be strapped on to a child to provide protection to the child's backside during a fall. FIG. 1 shows the front side of the child with the protector strapped onto the child. FIG. 2 shows the backside of a child wearing the protector (10). FIG. 3 shows the right side of a child wearing the protector (10). FIG. 4, shows a child being protected by the protector during a fall and in FIG. 5 after falling.

Figure 6:
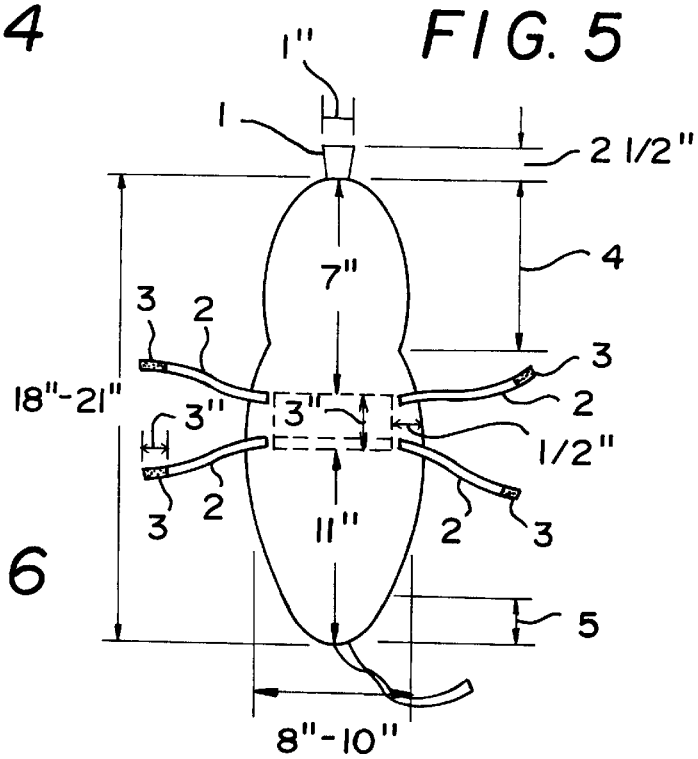
FIG. 6 is a plan view of the inner surface of the protector.

In FIG. 6, the interior view of the preferred embodiment of the protector (10) is shown. The protector (10) is constructed of a main body portion (13) which is predominantly oval shaped but is contoured to conform to the outline shape of a child's body by having a smaller oval-shaped upper portion, indentions along the two side edges approximately midway through its length and a larger oval shaped lower portion.

The protector has two ends, a top end (50) and a bottom end (60) and left (30) and right (31) sides. A loop of fabric (12) is attached to the top end (50) to function as a handle to be held by an adult to assist the child in attempting to walk. Straps (16) and (20) are attached to the inner right side (31) and straps (17) and (21) at the inner left side (30) of the protector at the middle. The straps 16 and 20 have corresponding hook and loop fasteners 18*a* at their ends and straps 17 and 21 have corresponding fasteners 19*a* and 19*b* to malleably and releasible attach as desired to fasten the protector to the wearer.

What is claimed is:

1. A child head, back and torso protector for protecting a child from falls when learning to walk comprising:

a main portion being constructed of polyurethane foam and substantially oval-shaped and also sized and contoured to cover the shape of a back of a child's head, back and torso including a child's tailbone; and wherein the main portion has an outer and inner surface and left and right side edges, and wherein said outer surface is covered with a material layer; and wherein said main portion has four straps permanently attached to the inner surface of the main portion at each of the left and right sides; and wherein said straps each have two ends wherein one end is attached to the main portion and the other ends are free and have hook fasteners on the left side straps and loop fasteners on the right side straps; wherein the straps wrap around the body of the child when the protector is worn on the child's back and wherein the ends of the straps connect at the front of the child to retain the protector on the back of the child.

* * * * *